US011841204B2

(12) United States Patent
Morris

(10) Patent No.: US 11,841,204 B2
(45) Date of Patent: Dec. 12, 2023

(54) FIREARM MAGAZINE TOOL

(71) Applicant: New Revo Brand Group, LLC, Plymouth, MN (US)

(72) Inventor: Matthew C. Morris, Minneapolis, MN (US)

(73) Assignee: NEW REVO BRAND GROUP, LLC, Plymouth, MN (US)

( * ) Notice: Subject to any disclaimer, the term of this patent is extended or adjusted under 35 U.S.C. 154(b) by 486 days.

(21) Appl. No.: 17/155,104

(22) Filed: Jan. 22, 2021

(65) Prior Publication Data

US 2021/0231402 A1 Jul. 29, 2021

Related U.S. Application Data

(60) Provisional application No. 62/965,023, filed on Jan. 23, 2020.

(51) Int. Cl.
*F41A 35/00* (2006.01)
*F41A 9/82* (2006.01)

(52) U.S. Cl.
CPC ..... *F41A 35/00* (2013.01); *F41A 9/82* (2013.01)

(58) Field of Classification Search
CPC ..... F41A 35/00; F41A 9/82
See application file for complete search history.

(56) References Cited

U.S. PATENT DOCUMENTS 4,304,062 A * 12/1981 Pepe ..... F41A 9/83 42/87
D344,780 S * 3/1994 Jenkins ..... D22/108
5,417,003 A 5/1995 Claveau
5,906,065 A * 5/1999 Pearce ..... F41A 9/65 42/50
6,810,616 B2 11/2004 Tal et al.
7,712,243 B2 * 5/2010 Morando ..... F41A 9/65 42/108
7,805,874 B2 10/2010 Tal et al.
D641,453 S * 7/2011 Stone ..... D22/199
8,091,266 B2 1/2012 Huang
(Continued)

OTHER PUBLICATIONS

"NcSTAR VTGLMAG Magpopper Magazine Disassembly Tool, Glock"; Apr. 13, 2021; https://www.amazon.com/NcSTAR-VTGLMAG-Magpopper-Magazine-Disassembly/dp/B0742JNRCY/ref=sr_1_3?dchild=1&keywords=ncstar+magpopper+magazine+disassembly+tool&qid=1620081309&sr=8-3.
(Continued)

*Primary Examiner* — Jason L Vaughan
(74) *Attorney, Agent, or Firm* — GRUMBLES LAW PLLC; Brittany Haanan

(57) ABSTRACT

A firearm magazine tool including a core having a floor on its top, a channel rib on the core, a cavity, a frame surrounding the core and the cavity, a lever pin projecting from the core into the cavity, and a slider pin projecting orthogonally from the floor. The channel rib can be an elongate projection running a partial length of the core. The core can be inset within the frame such that two internal frame side walls and an internal frame end wall are at least partially exposed above the floor. The cavity can be located between the core and a lever wall, the lever wall being located on an opposite end of the frame than the internal frame end wall. The firearm magazine tool can be further comprised of a channel on a bottom surface of the core, wherein the channel rib is located in the channel.

20 Claims, 6 Drawing Sheets

(56) References Cited

U.S. PATENT DOCUMENTS

| | | | | |
|---|---|---|---|---|
| 8,171,825 | B1 | 5/2012 | Adams | |
| D671,612 | S * | 11/2012 | Azhocar | F41A 35/00 D22/108 |
| 8,793,919 | B1 | 8/2014 | Probst, Jr. et al. | |
| 9,080,837 | B2 | 7/2015 | Horne | |
| 9,772,152 | B1 | 9/2017 | Niccum | |
| 9,921,016 | B1 | 3/2018 | Couie | |
| D821,534 | S | 6/2018 | Couie | |
| 10,001,331 | B2 | 6/2018 | Couie | |
| 10,060,692 | B2 * | 8/2018 | Couie | F41A 9/67 |
| 11,385,004 | B2 * | 7/2022 | Sredl | F41A 9/83 |
| 2012/0192477 | A1 | 8/2012 | Kim | |
| 2013/0074393 | A1 | 3/2013 | Curry | |
| 2018/0328685 | A1 | 11/2018 | Cheng et al. | |

OTHER PUBLICATIONS

"Magazine Disassembly Tool for Glock T1144"; Apr. 13, 2021; https://www.amazon.com/Magazine-Disassembly-Tool-Glock-T1144/dp/B00LG64MHO/ref=sr_1_5?dchild=1&keywords=magazine+disassembly+tool+for+glock+t1144&qid=1620080983&sr=8-5.

"Lone Wolf Dist Glock Magazine Disassembly Tool Review—Firearms Insider Community"; Jul. 5, 2014; http://www.firearmsinsider.tv/gun-gear-reviews/lone-wolf-dist-glock-magazine-disassembly-tool-review.

CCRS Industry, LLC—MAGGCLAW Base Plate Removal Tool for Glock®; https://www.brownells.com/search/index.htm?k=MAGGCLAW+BASE+PLATE+REMOVAL+TOOL+FOR+GLOCK&ksubmit=y.

"Mag Base Removal Tool for the Glock"; https://old.hyve-technologies.com/index.php/product/mag-base-removal-tool/.

* cited by examiner

FIG. 1
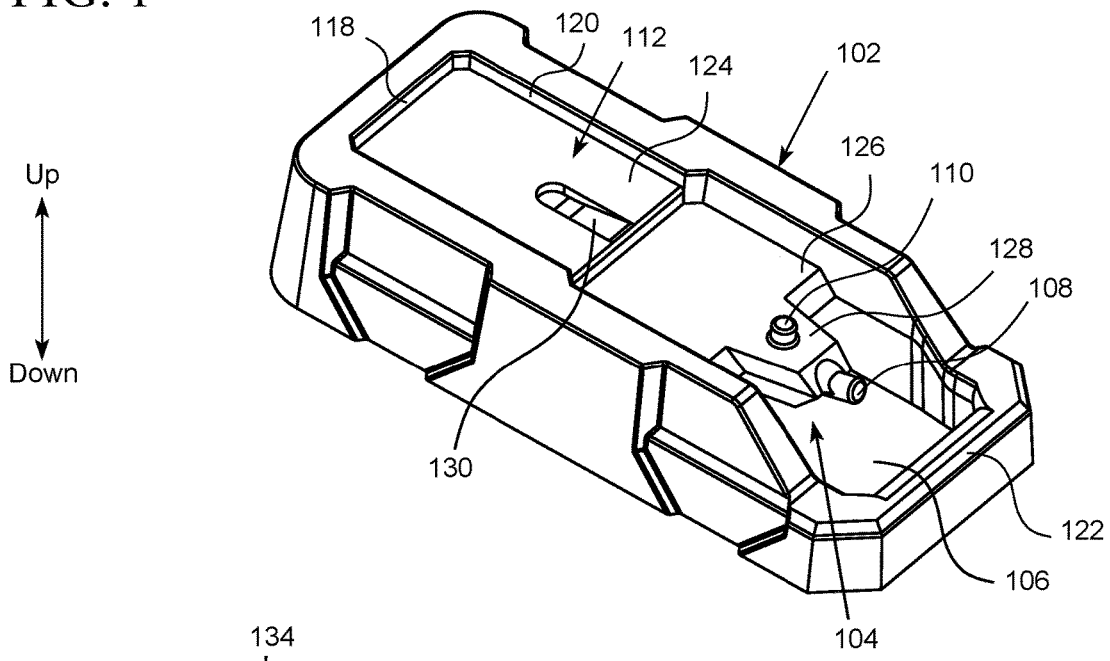
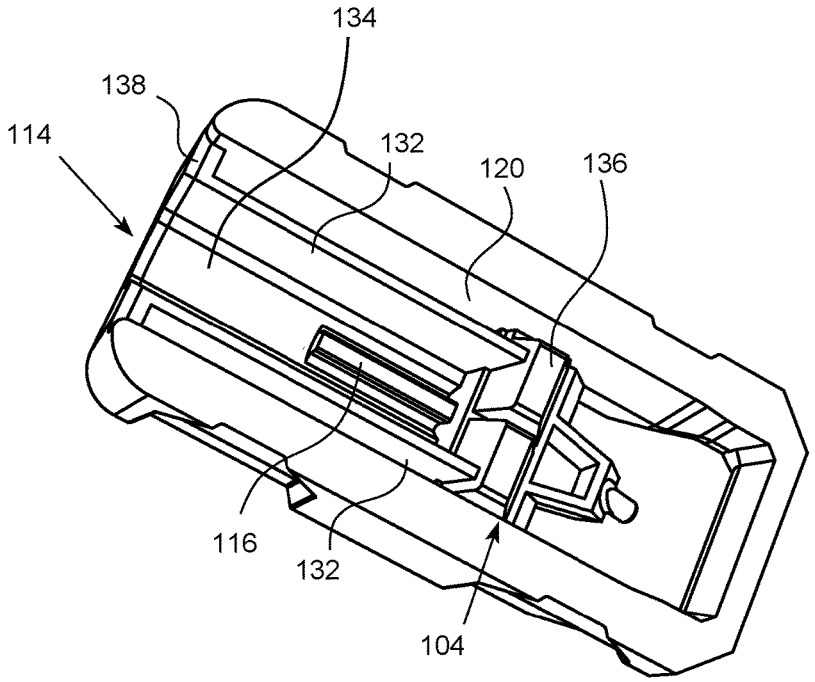
FIG. 2

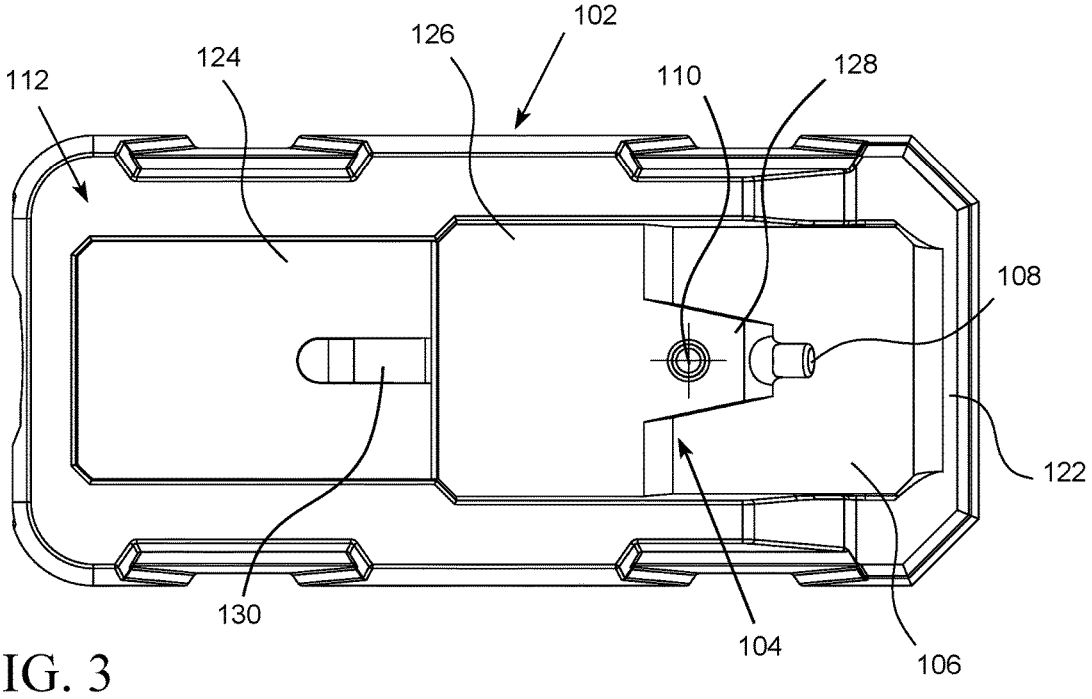
FIG. 3
FIG. 4
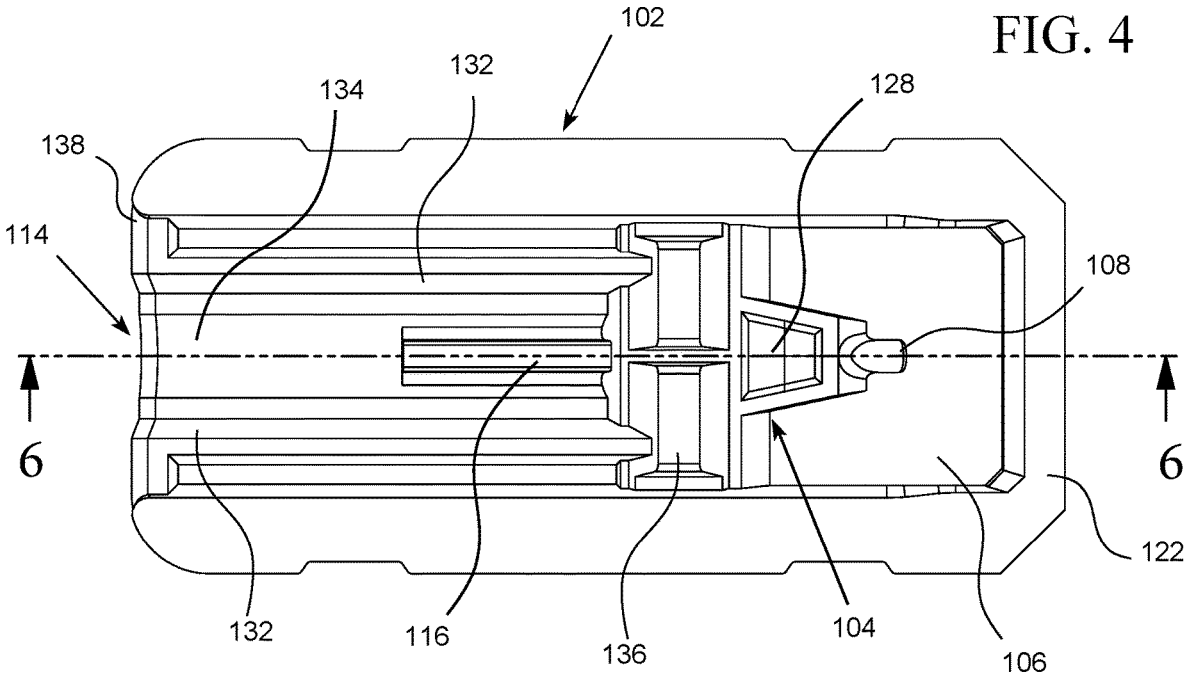

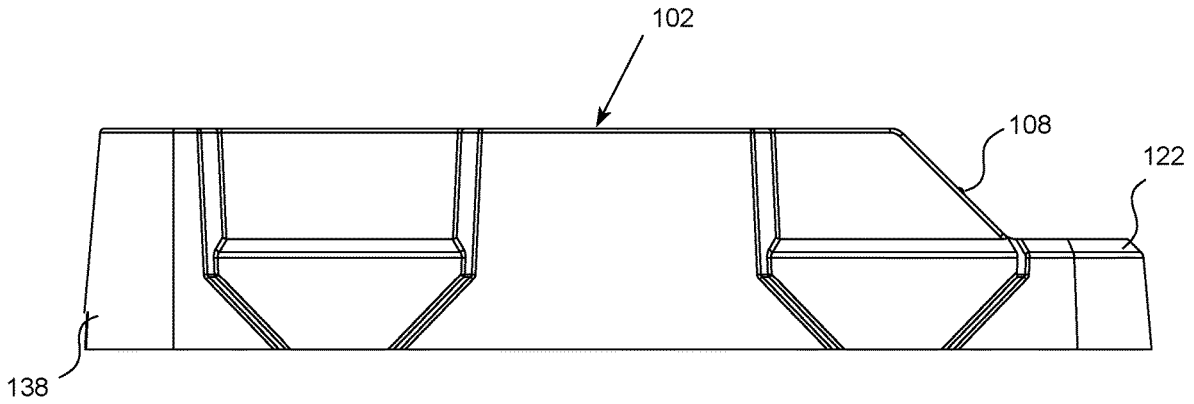
FIG. 5
FIG. 6
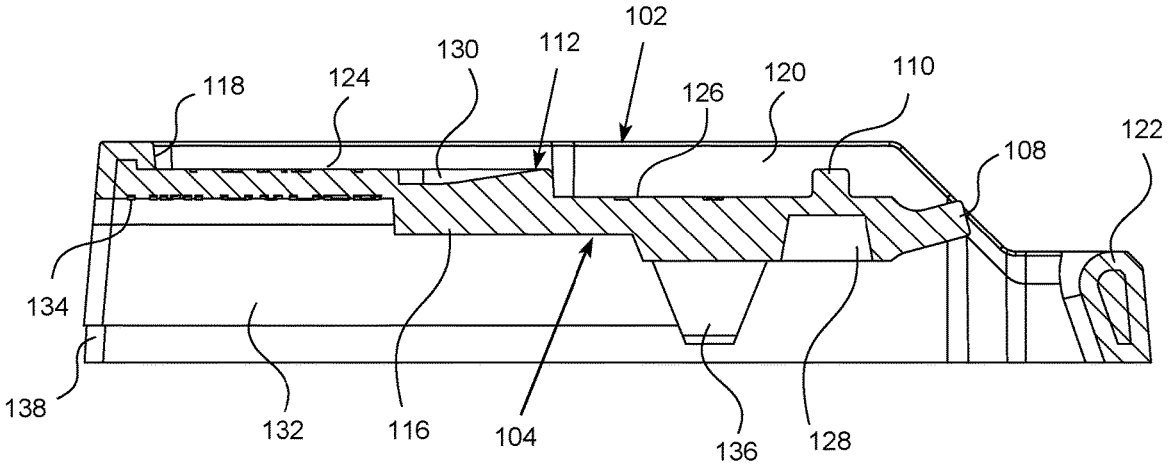

FIG. 9
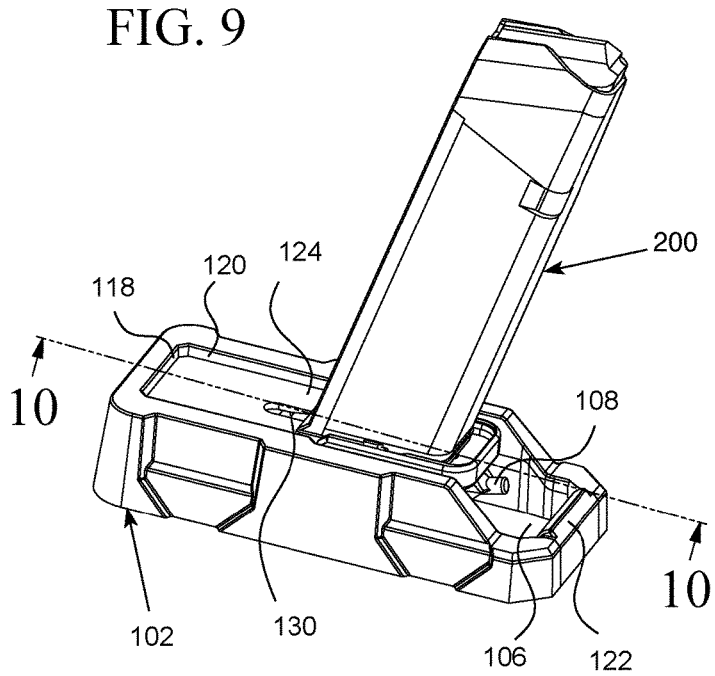
FIG. 10
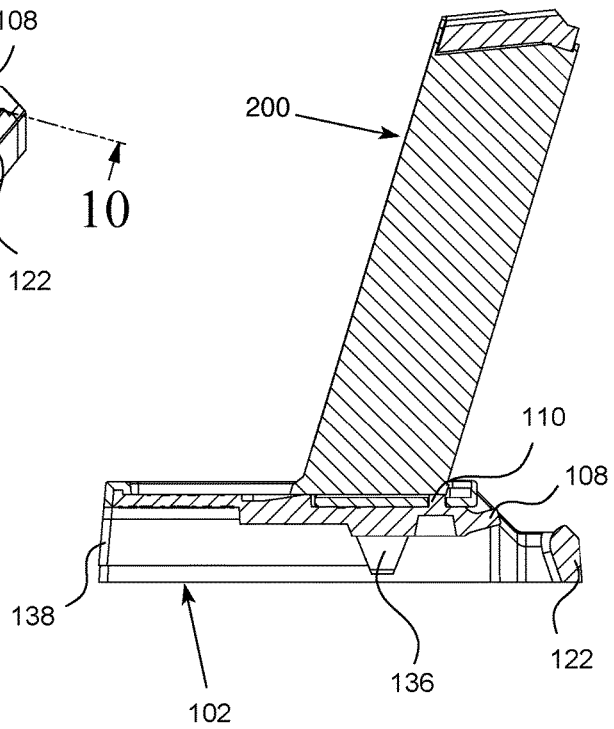
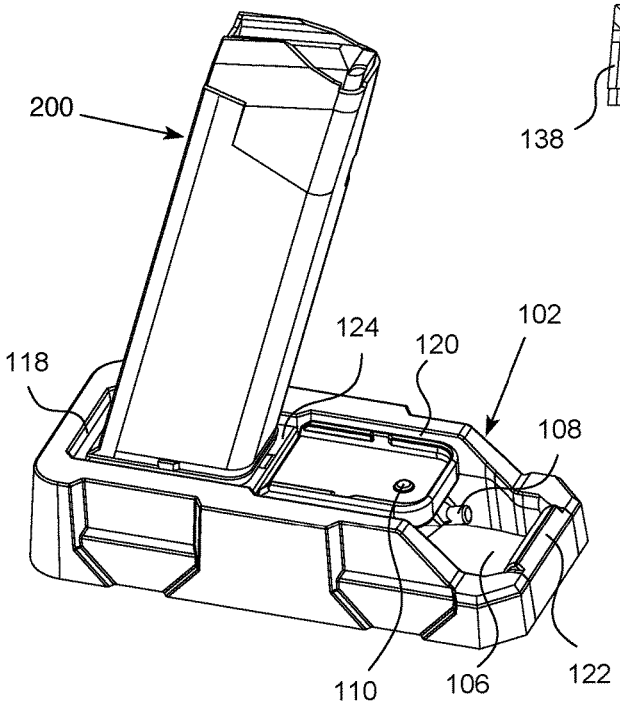
FIG. 11

FIREARM MAGAZINE TOOL

FIELD OF THE INVENTION

This disclosure relates to firearm maintenance aids, and more particularly to tools for assisting with removal and assembly of baseplates of, and unloading of ammunition from, firearm magazines.

BACKGROUND OF THE INVENTION

During maintenance activities, semi-automatic firearms such as handguns often require loading and unloading of magazines. Tools that assist with loading and unloading of magazines are known in the field. However, many of them only accomplish one such related task (i.e., removal of the magazine base plate, assembly of the magazine base plate, or removal of ammunition). Further, many of them do not account for the spring inside the magazine that is compressed until it is released from the magazine, thereby allowing for various parts of the magazine to scatter when the base plate is removed. It would be desirable to provide a tool that can facilitate removal of the magazine base plate, assembly of the magazine base plate, and removal of ammunition and that can decrease the probability of various parts of the magazine being lost due to an uncontrolled removal of the magazine base plate.

SUMMARY OF THE INVENTION

This disclosure relates to firearm maintenance aids, and more particularly to tools for assisting with removal and assembly of baseplates of, and unloading of ammunition from, firearm magazines. In an illustrative but non-limiting example, the disclosure provides a firearm magazine tool that can include a core having a floor on its top, a channel rib on the core, a slider pin projecting orthogonally from the floor, and a lever pin projecting from the core at a non-parallel angle to the floor. The channel rib can be an elongate projection running at least a partial length of the core. Further, the channel rib can be on a bottom surface of the core. In some cases, the floor may have a central groove.

The firearm magazine tool can also include a frame surrounding the core and a cavity. The lever pin can project from the core into the cavity at an angle less than 90 degrees from the slider pin. The core can be inset within the frame such that two internal frame side walls and an internal frame end wall are at least partially exposed above the floor. The cavity can be located between the core and a lever wall, the lever wall being located on an opposite end of the frame than the internal frame end wall.

In some examples, the floor can be further comprised of an upper step and a lower step, and the lower step can be inset further within the frame than the upper step, thereby creating increased exposed heights of the internal frame side walls near the lower step. The step protrusion can project into the cavity from an end of the lower step. The lever pin can project into the cavity from the step protrusion. The slider pin can also project orthogonally from the step protrusion. In some cases, the cavity can be located between the lower step and the lever wall. The lever wall may be shorter in height than the internal frame end wall, and the lever pin may project into the cavity at a non-parallel angle to the floor.

The firearm magazine tool can be further comprised of a channel on a bottom surface of the core. The channel can be defined by a channel base, channel side walls, a channel back wall, and the frame end wall. The channel back wall can be located on an opposite end of the channel from the frame end wall. The channel rib can be an elongate projection running at least a partial length of the channel base from the channel back wall towards the frame end wall. The frame end wall can have an opening, and the opening can be at least as wide and as deep as the channel.

In another illustrative but non-limiting example, the method of disassembling a firearm magazine includes the steps of placing a magazine release port of a base plate onto a lever pin; rotating the magazine body downward to cause the base plate to partially separate from the magazine body; separating the magazine release port from the lever pin; placing the magazine release port onto a slider pin that can project from the core; and pushing the magazine body away from the release port to entirely separate the base plate from the magazine body. The lever pin can project from a core of a firearm magazine tool, and the base plate can attach to a magazine body of a firearm. In some cases, the core may have a floor and may be surrounded by a frame, wherein the lever pin can project at a non-parallel angle to the floor, and wherein the slider pin can project orthogonally from the floor.

Further steps of the above method may include placing a bottom of the firearm magazine tool onto an open end of a magazine having at least one loaded round; aligning an end of a channel rib with a flat end of the round; and sliding the magazine along the channel rib to cause the channel rib to push the round out of the magazine. The channel rib can be on a bottom of the core.

The above summary is not intended to describe each and every example or every implementation of the disclosure. The description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which:

FIG. 1 is a top perspective view of an illustrative example of a firearm magazine tool of the present disclosure;

FIG. 2 is a bottom perspective view of the firearm magazine tool;

FIG. 3 is a top plan view of the firearm magazine tool;

FIG. 4 is a bottom plan view of the firearm magazine tool;

FIG. 5 is a right side elevational view of the firearm magazine tool;

FIG. 6 is a right side sectional view of the firearm magazine tool taken from the line 6-6 in FIG. 4;

FIG. 9 is a front perspective view of the firearm magazine tool engaged with a base plate of a magazine;

FIG. 10 is a right side sectional view of the firearm magazine tool engaged with the base plate of the magazine taken from the line 10-10 in FIG. 9;

FIG. 11 is a front perspective view of the firearm magazine tool engaged with a base plate of a magazine, wherein the base plate has been removed from the magazine body;

DETAILED DESCRIPTION

Figure 7:
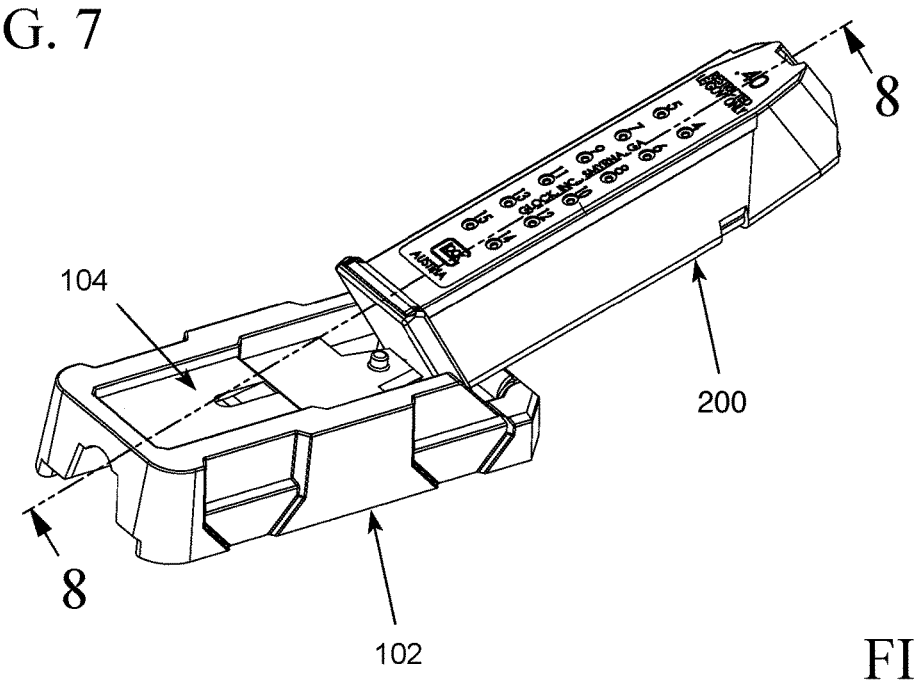
FIG. 7 is a right side perspective view of the firearm magazine tool engaged with a base plate of a magazine.
Figure 8:
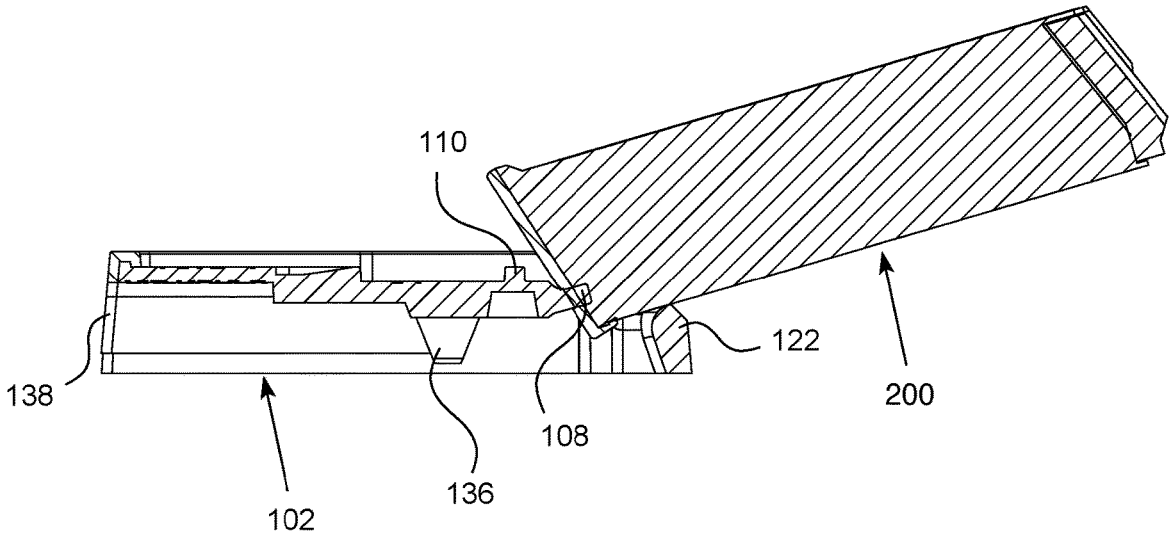
FIG. 8 is a right side sectional view of the firearm magazine tool engaged with the base plate of the magazine taken from the line 8-8 in FIG. 7.
Figure 12:
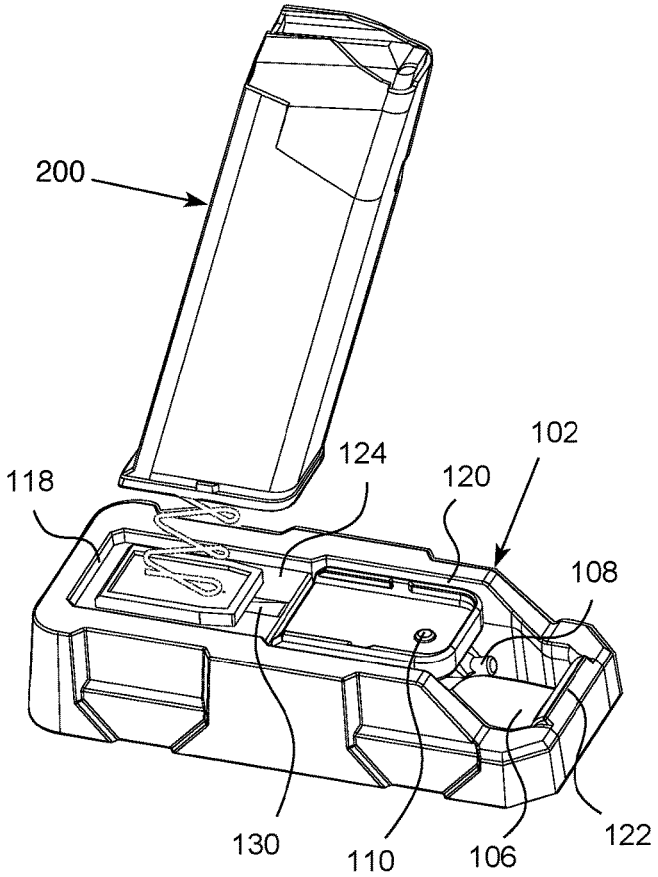
FIG. 12 is a front perspective view of the firearm magazine tool engaged with a base plate of a magazine, wherein the base plate and the spring retention plate have been removed from the magazine body.

The present disclosure relates to firearm maintenance aids, and more particularly to tools for assisting with removal and assembly of baseplates of, and unloading of ammunition from, firearm magazines. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

FIG. 1 is a top perspective view of an illustrative example of a firearm magazine tool of the present disclosure. Firearm magazine tool can include frame 102, core 104, cavity 106, lever pin 108, and slider pin 110, wherein the core includes floor 112 and channel 114 having channel rib 116. Frame 102 can surround all internal components, such as core 104 and cavity 106, as illustrated in FIGS. 1-4. Lever pin 108 can project from core 104 into cavity 106, as illustrated in FIGS. 1-4, and slider pin 110 can project orthogonally upward from floor 112 (i.e., the top of the core), as illustrated in FIGS. 1 and 3. Further, firearm magazine tool can include channel rib 116 within channel 114 on a bottom surface of core 104, as illustrated in FIGS. 2 and 4.

Additional views of firearm magazine tool are provided. FIG. 2 is a bottom perspective view of the firearm magazine tool. FIG. 3 is a top plan view of the firearm magazine tool. FIG. 4 is a bottom plan view of the firearm magazine tool. FIG. 5 is a right side elevational view of the firearm magazine tool. FIG. 6 is a right side sectional view of the firearm magazine tool.

FIGS. 7-13 illustrate the various engagements the tool can make with a firearm magazine.

Frame 102 of firearm magazine tool can be substantially shaped as a regular rectangle and can be formed in any suitable manner of any suitable material. Frame 102 can substantially surround the perimeter of core 104 and cavity 106, as illustrated in FIGS. 1-4. For example, frame 102 can be overmolded around core 104, and the core and frame can be structured and configured such that the frame and core substantially cannot be non-destructively separated. However, other embodiments may have frame 102 and core 104 manufactured separately, and structured and configured to be fit together after manufacture.

In some embodiments, frame 102 can be manufactured from a non-slip material providing a high friction coefficient such as, but not limited to, a natural or synthetic rubber or similar material. A rubber material can exhibit useful properties for frame, including tackiness or high-friction between the frame and a surface, such as a table or workbench upon which the firearm magazine tool may lay. In some examples, frame material can be provided in multiple non-connected pieces located on portions of a core where they can lend high-friction properties. Such multiple pieces of frame material may be referred to in the context of the present disclosure in the singular as "a frame." In some examples, such as that of firearm magazine tool of the Figures, a frame can include frame material that is substantially connected or contiguous. In some examples, a frame can consist essentially of frame material that is contiguous.

As illustrated in FIG. 1, a top edge of frame 102 can lay substantially in a plane. Similarly, as illustrated in FIG. 2, a bottom edge of frame 102 can lay substantially in a plane. In both cases, core 104 can be displaced from top and bottom edges of frame 102 such that the top edge of frame can be above floor 112, internal frame end wall 118, and internal frame side walls 120, and the bottom edge of frame can be beneath channel side walls 132. Therefore, core 104 can be inset within frame 102 leaving internal frame side walls 120 and internal frame end wall 118 at least partially exposed above floor 112.

When the substantially planar bottom edge of frame 102 rests against a surface, such as a tabletop or other work surface, friction between the bottom edge of the frame and the surface can substantially prevent slippage of the firearm magazine tool relative to the surface, when the tool is subject to typical forces that it would be expected to be subject to during normal use. When the firearm magazine tool is in use for removing a base plate of a magazine, floor 112 and the sides of frame can constrain a magazine that may slide along the floor.

In some examples, the frame may not necessarily be the top or highest part of the firearm magazine tool at all places around the perimeter of the tool. For example, at some places, a portion of the core may be the highest part, and at other places, the frame may be the highest part. In some cases, the highest parts of a firearm magazine tool around the perimeter of the tool (whether frame and/or core) can lay substantially in a plane, and the magazine can be contained within those highest parts. In some cases, the highest parts of a firearm magazine tool around the perimeter of the tool can deviate from a plane, but the magazine can still be contained and not slip, slide, or otherwise escape the confines of the firearm magazine tool.

Similarly, the frame may not necessarily be the bottom or lowest part of the firearm magazine tool at all places around the perimeter of the tool. For example, at some places, a portion of the core may be the lowest part, and at other places, the frame may be the lowest part. In some cases, the lowest parts of a firearm magazine tool around the perimeter of the tool (whether frame and/or core) can lay substantially in a plane, and the magazine can be contained within those lowest parts when the tool is placed on top of it. In some cases, the lowest parts of a firearm magazine tool around the perimeter of the tool can deviate from a plane, but the magazine can still be contained and not slip, slide, or otherwise escape the confines of the firearm magazine tool.

In some embodiments, an internal portion of frame 102 is comprised of internal frame end wall 118, internal frame side walls 120, and lever wall 122. While in some cases, all four internal walls may be of equal height, in other cases, lever wall 122, which can be located on an opposite end of frame than internal frame end wall 118, can be shorter in height than the internal frame end wall and at least a portion of internal frame side walls 120. For example, internal frame side walls 120 may primarily be of the same height as internal frame end wall 118 but, as they near lever wall 122, they may slope downward so as to meet the lever wall at its lower height, as illustrated in FIG. 1. Further, while internal side walls 120 may be equidistant from each other along their lengths, in some cases portions of internal side walls are closer together than other parts. For example, back portions of internal side walls 120 may be closer to each other than front portions, as illustrated in FIGS. 1 and 3.

In some cases, lever wall 122 may additionally have a bumper (not illustrated) along the length of its top edge, which can increase its height. The bumper can be used as a leverage point when cracking open a base plate, as described in more detail below. Therefore, the bumper may be comprised of a different, more rigid material than frame 102. Further, in some cases, at least a portion of lever wall 122 may also be comprised of a more rigid material, such that the edges of lever wall are a continuation of the material for internal frame end wall 118 and internal frame side walls 120, but a central length of lever wall is comprised of a second, more rigid material. Therefore, lever wall 122 and the bumper may be comprised of the same material that can better withstand pressure and impact than the rest of frame 102.

Similar to bumper and portions of lever wall 122, core 104 of firearm magazine tool can be formed of a rigid material such that the core cannot be folded, bent, or otherwise forced out of shape. In some embodiments, core 104 can be manufactured from an engineering resin such that the core can robustly resist breakage or deformation, yet generally will not mark or mar firearm parts and surfaces with which it comes into contact. Examples of materials used for core 104 can include, but are not limited to, plastic (for example, high-density polyethylene, polyvinyl chloride, polypropylene, other thermoplastic polymers, etc.), high durometer rubber, and combinations thereof. However, core 104 can be formed in any suitable manner of any suitable material. Further, core 104 can be substantially shaped along its perimeter as a regular rectangle.

As mentioned above, the firearm magazine tool can be used to facilitate removal of a magazine base plate, assembly of the magazine base plate, and removal of ammunition. Therefore, core 104 can be comprised of floor 112 on its top and channel 114 on its bottom. Floor 104 can be used in combination with lever pin 108 and slider pin 110 to facilitate removal and assembly of the base plate. Channel 114 can be used to facilitate removal of ammunition.

More specifically, floor 112 can be further comprised of upper step 124, lower step 126, step protrusion 128, and central groove 130. Upper step 124 can be substantially flat and can be located between internal frame side walls 120 as well as nearest to internal frame end wall 118. Lower step 126 can similarly be substantially flat and can be located between internal frame side walls 120 as well as between upper step 124 and cavity 106. Therefore, cavity 106 can be located between core 104 (or, more specifically, lower step) and lever wall 122, wherein the lever wall can be located on an opposite side of frame than internal frame end wall 118. As illustrated in FIG. 1, step protrusion 128 can project into cavity 106 from an end edge of lower step 126 of core 104, and central groove 130 can be a sloped groove starting along front edge of upper step 124 and gradually increasing in depth as it moves closer towards internal frame end wall 118.

In some embodiments, upper step 124 can have a shorter width than lower step 126 due to a narrower width between internal side walls 120, as mentioned above. The wider width of lower step 126 can more closely align with the width of a base plate, whereas the narrower width of upper step 124 can more closely align to the dimensions of a spring retention plate, which is located in a firearm magazine and held in place with the base plate. Therefore, as a firearm magazine is slid from lower step 126 to upper step 124, the narrower width of the upper step can help prevent the base plate from sliding into the upper step, thus improving the likelihood that the base plate will be successfully removed. Further, by allowing the base plate to separate from the spring retention plate, upper step 124 can use spring retention plate to enable retention of the spring within the magazine after the base plate is removed so that the spring does not eject out into space and potentially get lost or damaged.

In addition to a narrower width, upper step 124 can include central groove 130. Central groove 130 can be positioned centrally along the width of the front edge of the upper step such that it aligns with a tab on the spring retention plate of the magazine. As mentioned above, central groove 130 can be a sloped groove that starts out shallow along front edge of upper step 124 and gradually increases in depth as it moves closer towards internal frame end wall 118. Alternatively, central groove 130 may have an equal depth entirely along its length.

Lower step 126, in addition to having a greater width than upper step 124, can also be inset further within frame 102 than the upper step, thereby creating an increased exposed height of internal side frame walls 120. In this manner, lower step 126 appears lower than upper step 124 when the bottom edge of frame 102 is resting against a surface such as a tabletop or other work surface. This difference in height can create a ledge between lower step 124 and upper step 126 that captures the base plate of a magazine and prevents it from continuing to slide when the magazine is being pushed from the lower step to the upper step for base plate removal.

Lower step 126 can further include step protrusion 128, which can project into cavity 106 from an end of the lower step of core 104 (for example, from an outer, exposed edge of the lower step). Step protrusion 128 can be a continuation of lower step 126 and can also be approximately flat with a narrower width than the lower step, as illustrated in FIGS. 3-4. The width of step protrusion 128 can be equal along its length. Alternatively, the width can vary. For example, the width may start out at its widest point where step protrusion 128 projects from lower step 126 and it may narrow as it extends into cavity 106. An outer, exposed edge of step protrusion 128 can be a flat, perpendicular face or it can be sloped to a point. Centrally positioned along the outer, exposed edge can be a first pin, such as lever pin 108, which can also project into cavity 106 from step protrusion 128. In some embodiments, a second pin, such as slider pin 110, can project orthogonally upward from floor 112 (for example, from a top of step protrusion 128).

As described above, floor 112 can be used in combination with lever pin 108 and slider pin 110 to facilitate removal and assembly of the base plate. More specifically, lever pin 108 and slider pin 110 can be cylindrical and can be sized to fit within a hole on base plate of magazine. In some embodiments, lever and slider pins 108, 110 may be equal in radius and height. In other embodiments, the pins 108, 110 may have different dimensions from each other. For example, lever pin 108 may be longer than slider pin 110 such that it provides additional leverage for a user when rotating the magazine body downward to partially separate the base plate from the magazine body. As mentioned above, lever pin 108 can project from core 104 into cavity 106, and slider pin 110 can project orthogonally from floor 112. To further assist with removal of the base plate, lever pin 108 can project into cavity 106 at a non-parallel angle to floor 112. More specifically, the angle at which lever pin 108 may project upward is specific to the height and distance of lever wall 122. For example, the lever pin angle can be between 10-25 degrees (for example, 15 degrees) upward from the horizontal plane of floor 112.

Therefore, to use the firearm magazine tool to remove a base plate from a magazine body, a user can place the tool on a surface, such as a tabletop or other flat work surface, insert a magazine release port of a base plate onto lever pin 108, rotate the magazine body downward and leverage it against bumper and/or lever wall 122 to partially separate the base plate from the magazine body, separate the magazine release port from the lever pin, place the magazine release port onto slider pin 110, and push the magazine body forward along floor 112 toward internal frame end wall 118 until the base plate is separated entirely from the magazine body. As mentioned above, the ledge created by the difference in height between upper step 124 and lower step 126 can catch the base plate so that it remains on the lower step as the magazine body continues to slide forward. Additionally, due to the mechanism by which the base plate is removed using the firearm magazine tool, the spring remains compressed until a user separates the magazine body from the tool. In this manner, the risk of losing parts, such as the spring or spring retention plate is substantially diminished.

To assemble a firearm magazine, the process is relatively similar. A user can place the tool on a surface, such as a tabletop or other flat work surface, place the base plate onto lower step 126 with slider pin 110 engaged in the magazine release port, place the spring retention plate of the magazine on upper step 124 with a tab of the plate resting in central groove 130, align the spring that is inside the magazine body with the spring retention plate and press down until the magazine body is resting on top of floor 112, and slide the magazine body backward into the base plate until the base plate is locked onto the magazine body.

Figure 13:
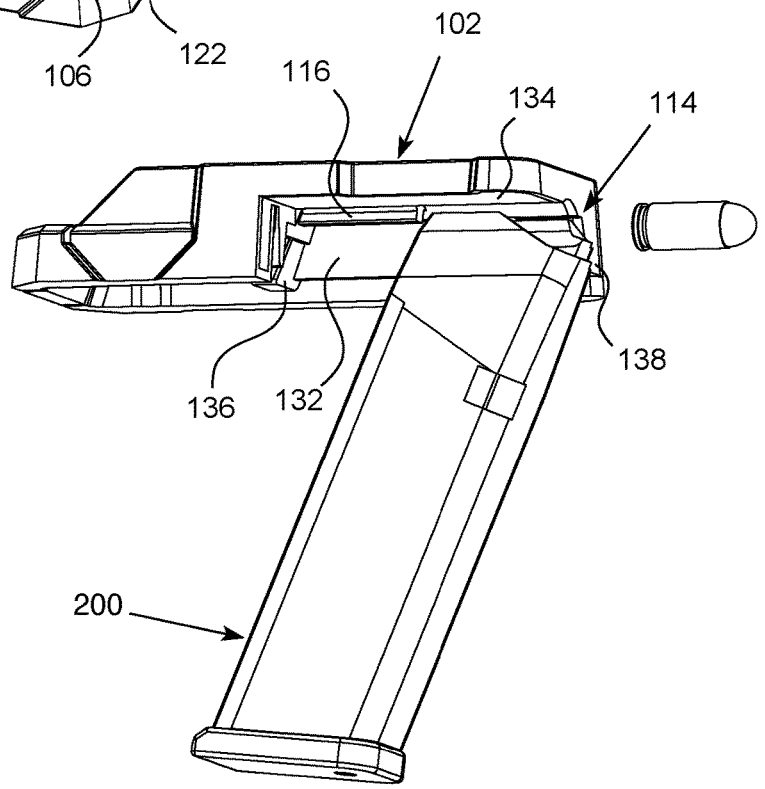
FIG. 13 is a left side partial cross-sectional view of the firearm magazine tool engaged with the upper end of a firearm magazine.

As mentioned above, in addition to facilitating removal and assembly of the magazine base plate, the firearm magazine tool can facilitate removal of ammunition through use of channel 114. For example, core 104 can include channel rib 116, which can push ammunition out of the top of a firearm magazine, as illustrated in FIG. 13. In some embodiments, channel rib 116 can be in channel 114.

More specifically, to assist channel rib 116 in removal of ammunition, channel 114 can be further defined by channel side walls 132, channel base 134, channel back wall 136, and frame end wall 138. Channel 114, and its component parts, can be manufactured from the same material as core 104 (for example, an engineering resin that can robustly resist breakage or deformation, yet generally will not mark or mar firearm parts and surfaces with which it comes into contact). Channel side walls 132 can be approximately parallel to internal frame side walls 120 but located closer together such that there is a space between the internal side walls and the external surface of the channel side walls, as illustrated in FIG. 2. Channel base 134 can be curved or arced and can be located between channel side walls 132, as illustrated in FIG. 4. Channel back wall 136 can be located on an opposite end of channel 114 from frame end wall 138 and approximately near the end of core 104, such that step protrusion 128 extends out past the channel back wall. Frame end wall 138 can be continuous from top to bottom of frame 102 and can connect to channel side walls 132 and channel base 134.

In some embodiments, channel base 134 has curvature that aligns with the curvature of ammunition such that the ammunition can have a snug fit and minimal side to side movement when it is being pushed out by channel rib 116. Further, the outer sides of channel base 134 can be flat, parallel to the bottom edge of frame 102, perpendicular to channel side walls 132, and in the same plane as each other. As mentioned above, channel rib 116 can be an elongate projection running at least a partial length of core 104 and channel base 134 from channel back wall 136 towards frame end wall 138. More specifically, channel rib 116 can project outward from channel base 134 starting at or near channel back wall 136. In some embodiments, channel rib 116 is approximately half the length of channel base 134. However, this is not required and channel rib 116 may be more or less than the half the length of channel base 134.

To indicate the bounds of channel base 134, channel side walls 132 can extend its entire length from channel back wall 136 out to frame end wall 138. Channel side walls 132 can also extend from channel base 134 downward. For example, they can extend to the bottom edge of frame 102. Alternatively, they can end at a position above bottom edge of frame 102 such that they will not make contact with a surface, such as a tabletop or other flat work surface, when the tool is placed thereon.

Channel back wall 136, as indicated above, can indicate the endpoint of channel 134 from within the bounds of frame 102. Additionally, channel back wall 136 can be manufactured from the same material as frame 102 (for example, a non-slip material providing a high friction coefficient such as, but not limited to, a natural or synthetic rubber or similar material) instead of the same material as core 104 (for example, an engineering resin that can robustly resist breakage or deformation, yet generally will not mark or mar firearm parts and surfaces with which it comes into contact). In some embodiments, channel back wall 136 can be approximately rectangular with a flat bottom, as illustrated in FIG. 2. Further, channel back wall 136 can have angled walls facing forward and back and may have a central gap separating the two sides. Similar to channel side walls 132, channel back wall 136 can extend to the bottom edge of frame 102, or it can end at a position above bottom edge of the frame such that it will not make contact with a surface, such as a tabletop or other flat work surface, when the tool is placed thereon.

On the opposite end of channel base 134 from channel back wall 136 can be frame end wall 138. Frame end wall 138 can indicate the endpoint of channel 114 as it nears the bounds of frame 102. In some embodiments, frame end wall 138 can have an opening that aligns with the general shape of channel base 134 and channel side walls 132. More specifically, the opening of frame end wall 138 can be at least as wide as the distance between channel side walls 132 and at least as deep as channel base 134 such that the top of a magazine can smoothly slide into and out of channel 114 for removal of ammunition.

Therefore, to use the firearm magazine tool to remove ammunition from a magazine body, a user can align the magazine body and ammunition between channel side walls 132 and underneath channel base 134 such that the channel base is in contact with the ammunition and/or magazine body but channel rib 116 is not, slide the tool forward to engage the flat end of the ammunition with the channel rib, push the ammunition out by continuing to move the tool forward until the magazine body makes contact with channel back wall 136, and lift the tool off the top of the magazine.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A firearm magazine tool comprising:

a core having a floor on its top;

a channel rib on the core, the channel rib being an elongate projection running at least a partial length of the core;

a slider pin projecting orthogonally from the floor; and a lever pin projecting from the core at a non-parallel angle to the floor.

2. The firearm magazine tool of claim 1, further comprising a frame surrounding the core and a cavity, wherein the lever pin projects from the core into the cavity at an angle less than 90 degrees from the slider pin.

3. The firearm magazine tool of claim 2, wherein the core is inset within the frame leaving two internal frame side walls and an internal frame end wall at least partially exposed above the floor.

4. The firearm magazine tool of claim 3, wherein the floor is further comprised of an upper step and a lower step, and wherein the lower step is inset further within the frame than the upper step, thereby creating increased exposed heights of the internal frame side walls near the lower step.

5. The firearm magazine tool of claim 4, wherein a step protrusion projects into the cavity from an end of the lower step.

6. The firearm magazine tool of claim 5, wherein the lever pin projects into the cavity from the step protrusion.

7. The firearm magazine tool of claim 6, wherein the cavity is located between the lower step and a lever wall, the lever wall being located on an opposite end of the frame than the internal frame end wall.

8. The firearm magazine tool of claim 5, wherein the slider pin projects orthogonally from the step protrusion.

9. The firearm magazine tool of claim 3, wherein the cavity is located between the core and a lever wall, the lever wall being located on an opposite end of the frame than the internal frame end wall.

10. The firearm magazine tool of claim 9, wherein the lever wall is shorter in height than the internal frame end wall and wherein the lever pin projects into the cavity at a non-parallel angle to the floor.

11. The firearm magazine tool of claim 1, wherein the floor has a central groove.

12. The firearm magazine tool of claim 1, wherein the channel rib is on a bottom surface of the core.

13. The firearm magazine tool of claim 12, further comprising a channel on the bottom surface of the core.

14. The firearm magazine tool of claim 13, wherein the channel is defined by a channel base, channel side walls, a channel back wall, and a frame end wall.

15. The firearm magazine tool of claim 14, wherein the channel back wall is located on an opposite end of the channel from the frame end wall.

16. The firearm magazine tool of claim 15, wherein the channel rib is an elongate projection running at least a partial length of the channel base from the channel back wall towards the frame end wall.

17. The firearm magazine tool of claim 14, wherein the frame end wall has an opening, the opening being at least as wide and as deep as the channel.

18. A method of disassembling a firearm magazine, the method comprising:

placing a magazine release port of a base plate onto a lever pin, wherein the lever pin projects from a core of a firearm magazine tool, and wherein the base plate is attached to a magazine body of a firearm;

rotating the magazine body downward to cause the base plate to partially separate from the magazine body;

separating the magazine release port from the lever pin;

placing the magazine release port onto a slider pin that projects from the core; and pushing the magazine body away from the release port to entirely separate the base plate from the magazine body.

19. The method of claim 18, wherein the core has a floor and is surrounded by a frame, wherein the lever pin projects at a non-parallel angle to the floor, and wherein the slider pin projects orthogonally from the floor.

20. The method of claim 18, the method further comprising:

placing a bottom of the firearm magazine tool onto an open end of a magazine, wherein the magazine has at least one loaded round;

aligning an end of a channel rib with a flat end of the round, wherein the channel rib is on a bottom of the core; and sliding the magazine along the channel rib to cause the channel rib to push the round out of the magazine.

* * * * *